United States Patent [19]

Yamazaki et al.

[11] Patent Number: 4,972,233

[45] Date of Patent: Nov. 20, 1990

[54] APPARATUS AND METHOD FOR CLEANING A PHOTOSENSITIVE MEMBER WITH SPHERICAL MAGNETIC PARTICLES

[75] Inventors: Koji Yamazaki, Ebina; Shigenori Ueda; Toshiyuki Ehara, both of Yokohama, all of Japan

[73] Assignee: Canon Kabushiki Kaisha, Tokyo, Japan

[21] Appl. No.: 231,459

[22] Filed: Aug. 12, 1988

[30] Foreign Application Priority Data

Aug. 17, 1987 [JP] Japan ..... 62-203154

[51] Int. Cl.[5] ..... G03G 21/00

[52] U.S. Cl. ..... 355/306; 355/305; 355/297; 118/652; 430/125

[58] Field of Search ..... 355/270, 251, 297, 305, 355/306, 211; 430/108, 110, 125; 118/652, 657

[56] References Cited

U.S. PATENT DOCUMENTS

| | | | |
|---|---|---|---|
| 2,874,063 | 2/1959 | Greig | 355/306 X |
| 4,142,165 | 2/1979 | Miyakawa et al. | 355/270 |
| 4,154,522 | 5/1979 | Ikesue | 355/296 X |
| 4,420,242 | 12/1983 | Yamashita | 355/270 |
| 4,488,802 | 12/1984 | Sunaga et al. | 355/270 |
| 4,607,934 | 8/1986 | Kohyama et al. | 355/211 X |
| 4,666,813 | 5/1987 | Sakashita | 430/110 |
| 4,699,865 | 10/1987 | Mitsuhashi | 430/125 X |

FOREIGN PATENT DOCUMENTS

| | | | |
|---|---|---|---|
| 56-138774 | 10/1981 | Japan . | |
| 57-53762 | 3/1982 | Japan | 355/306 |
| 59-121370 | 7/1984 | Japan . | |
| 60-151685 | 8/1985 | Japan | 355/306 |

*Primary Examiner*—R. L. Moses

*Attorney, Agent, or Firm*—Fitzpatrick, Cella, Harper & Scinto

[57] ABSTRACT

A image forming apparatus having cleaning means for cleaning a movable image bearing member, particularly, an amorphous silicon photosensitive material by scraping the image bearing member with both a blade which is brought into contact with the image bearing member and magnet spherical particles held on a magnet roller provided upstream of the blade in the moving direction of the image bearing member. The magnetic spherical particles are made of ferrite having an average particle diameter within a range from 30 to 200 μm, preferably, 60 to 100 μm. As a result abrasion of the photosensitive layer is minimized and foreign matter deposited on the photo sensitive layer is removed to prevent an image flow, so that both a good cleaning function and an image of good picture quality are obtained.

17 Claims, 2 Drawing Sheets

APPARATUS AND METHOD FOR CLEANING A PHOTOSENSITIVE MEMBER WITH SPHERICAL MAGNETIC PARTICLES

BACKGROUND OF THE INVENTION

1. Field of the Invention

The present invention relates to an image forming apparatus such as electrostatic copying apparatus, electrostatic printer, or the like having cleaning means for cleaning an image carrier by scraping the image carrier by magnetic particles held by means for holding the magnetic particles.

3. Related Background Art

Hitherto, there has been well known an image forming apparatus in which a sheet-shaped transfer material such as a paper of the like is brought into with a transferable toner image formed on the surface of an image carrier, this toner image is electrostatically transferred to the transfer material, the transfer material is then separated from the image bearing member, the residual toner which does not contribute to the transfer and remains on the surface of the image bearing member is removed by proper cleaning means such as a cleaning blade or the like, and these processes are repeated. In such an image forming apparatus, in recent years, miniaturization and weight reduction are being accomplished more and more. Further, ease in maintenance and simplicity of operation are demanded. In consideration of these points, as an image bearing member, an amorphous silicon photosensitive material is preferably used because the Vickers hardness is so high as to be about 1000, the durability is high, and the potential stability is good.

However, even in the case of an amorphous silicon photosensitive material, when it is repetitively used, it becomes sensitive to humidity and water is easily absorbed into this material, so that an image defect such as image flow or the like occurs. Particularly, when the apparatus is set to the inoperative mode for a long time, a degree of the trace flow of an electrifier which is caused in the surface portion of the photosensitive material which faces the transfer and separating electrifiers and an electrifier for generating an AC corona is large, causing a problem.

Several causes of such a state are considered. First, it is considered that the corona product which is produced due to a high voltage generating member existing in such a kind of apparatus is deposited onto the surface of the photosensitive material and absorbs the moisture component, a resistance value of the deposited corona product becomes low, so that the charges adapted to form an electrostatic latent image leak in the lateral direction. Second, it is considered that for the trace flow of the electrifier, the volatile ozone product deposited onto a shielding plate of the electrifier moves to the surface of the photosensitive material when the apparatus stops.

Further, since many dangling bonds exist in the silicon atoms which construct the photosensitive material, they are sealed and linked by the hydrogen atoms. However, when the photosensitive material is repetitively used, the hydrogen atoms are disconnected, so that a more stable oxygen coupling occurs. When a concentration of the oxygen coupling increases, the electrostatic latent image forming charges leak in a manner similar to the above case because oxygen is hydrophilic. This point is also considered to be the third cause.

Even when considering any of these causes, in order to avoid the occurrence of such an unpreferable situation, hitherto, there has been proposed a method whereby the image carrier is heated by proper heating means to thereby eliminate water, a method whereby the surface of the photosensitive material is scraped by a cleaning roller consisting of an elastic material like a rubber or the like to thereby eliminate the ozone product, or a method whereby the surface layer which becomes sensitive to humidity is ground and removed.

However, since the amorphous silicon photosensitive material has such a characteristic that the charging capability deteriorates due to the heating, it is unpreferable to use the heating means. On the other hand, according to the method of grinding the surface of the photosensitive material by the cleaning roller, a grinding variation occurs, so that there is a fear such that such a grinding variation causes a sensitivity variation of the photosensitive material and, further, a deterioration of the image.

Further, there have been proposed a method whereby a magnet roller is used and the photosensitive material is scraped by using a toner brush formed on the magnet roller as is disclosed in Patent Application Laid-open No. 56-138774, and a method whereby a sleeve having therein a magnet roller is formed with a brush consisting of magnetic particles, the photosensitive material such as amorphous silicon or the like is scraped by this brush, and thereby preventing that the photosensitive material is excessively ground as disclosed in Patent Application Laid-open No. 59-121370. However, although even these methods are improved methods as compared with the foregoing method of scraping the photosensitive material by an elastic roller, the grinding of the photosensitive material still causes a problem.

On the other hand, particularly, in the case of using a color toner such as red, blue, or the like other than black, which has been used in the recent image forming apparatus, since the color toner is generally a nonmagnetic material, it is difficult to collect it by the magnet roller or the like and a toner brush cannot be formed.

SUMMARY OF THE INVENTION

The present invention is made in consideration of the foregoing points and it is an object of the present invention to provide an image forming apparatus in which a hard image bearing member having high abrasion resistance is used and the foreign matters deposited on the image bearing member which deteriorate the characteristic of the image carrier can be eliminated without a fear of occurrence of a grinding variation and also to provide a cleaning apparatus of such an image forming apparatus and its method.

Another object of the invention is to provide an image forming apparatus which can preferably clean an image bearing member even by use of either a magnetic toner or a nonmagnetic toner as a developing agent and also to provide a cleaning apparatus of such an image forming apparatus and method thereof.

The above and other objects and features of the present invention will become apparent from the following detailed description and the appended claims with reference to the accompanying drawings.

DETAILED DESCRIPTION OF THE PREFERRED EMBODIMENTS

An embodiment of the present invention will be described hereinbelow with reference to the drawings.

Figure 1:
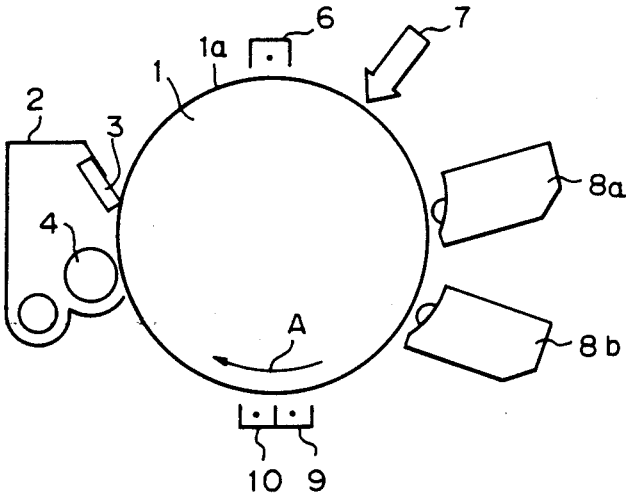
FIG. 1 is a schematic cross sectional view of an image forming apparatus showing an embodiment of the present invention.

FIG. 1 is a cross sectional view of the main section in the embodiment in the case where the invention is applied to an image forming apparatus having a cylindrical rotational image bearing member. A photosensitive layer 1*a* consisting of amorphous silicon is formed on the surface of an image bearing member 1 which extends in the vertical direction to the surface of the sheet and rotates in the direction indicated by an arrow A. A cleaning apparatus 2 is arranged closely and in parallel with the image carrier 1.

As shown in FIG. 1, as is well known, around the image bearing member 1 which rotates in the direction of the arrow A, the photosensitive layer 1*a* on the surface of the image bearing member is uniformly charged by a primary corona electrifier 6, the light corresponding to image information is irradiated onto the charged photosensitive layer la by light irradiating means 7 serving as image information applying means, and an electrostatic latent image is formed onto the surface of the image bearing member 1. Next, the latent image is developed by developing devices 8*a* and 8*b*. The developed image is transferred onto a transfer material (not shown) by a transfer corona electrifier 9. The transfer material is separated from the image bearing member 1 by a corona separating electrifier 10. After the transfer material was separated, the unfixed image on the transfer material is fixed by a fixing device (not shown) and the remaining toner on the image bearing member 1 is collected by the cleaning apparatus 2 which is arranged downstream of the transfer corona electrifier 9 in the moving direction of the image bearing member 1 and upstream of the primary corona electrifier 6 in the moving direction of the image bearing member 1.

The developing device 8*a* has a black insulative one component magnetic toner. The developing device 8*b* has a colored insulative non-magnetic toner and magnetic carriers. The toner may be red or the like.

The cleaning apparatus 2 will now be described in detail hereinafter with reference to FIGS. 1 and 2.

One of the edges of a cleaning blade 3 made of a proper elastic material such as urethane rubber or the like is brought into pressure contact with the cleaning apparatus 2. When the residual toner which does not contribute to the transfer of the image in the transferring portion and remains on the surface of the image bearing member 1 comes to the position of the cleaning blade 3, this remaining toner is rubbed and removed from the surface of the image bearing member 1. In the apparatus shown in the diagram, a magnet roller 4 is arranged near the image bearing member 1 upstream of the cleaning blade 3 in the moving direction of the image bearing member 1.

Figure 2:
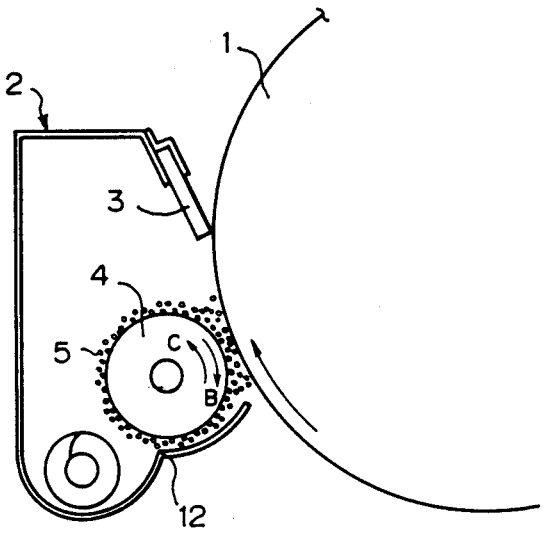
FIG. 2 is a cross sectional view of a main section in a cleaning apparatus in the image forming apparatus of this embodiment.

As shown in FIG. 2, a brush is previously formed on the surface of the magnet roller 4 so as to form ears with spherical particles 5 made of a magnetic material. A thickness of the layer of the brush is restricted by a scraper 12. The roller 4 is rotated so as to keep a proper speed difference between the magnet roller 4 and the image bearing member, 1, thereby scraping the photosensitive layer with the brush consisting of the spherical particles 5.

In the case where a brush is formed on the magnet roller 4 so as to form ears by using well-known monolithic or flat-shaped iron particles as particles for scraping, when a predetermined magnetic force is applied to the iron particles, the saturation magnetizing force as a magnetic force thereof is also large (150 to 200 emu/g at 1000 Oe) and, further, the mechanical coupling action between particles due to their shapes is also applied, so that the brush forming force is large. Consequently, when the photosensitive layer la on the surface of the image carrier 1 is scraped, the grinding action operates too strongly Therefore, it is preferable that spherical ferrite particles (60 to 80 emu/g at 1000 Oe) which are formed by constructing spherical particles from the liquid phase and then sintering are used as the scraping particles.

Now, the spherical particles are defined as follows.

$$1 \leqq \frac{\text{length of sphere}}{\text{breadth of sphere}} \leqq 1.2$$

$$\text{preferably, } 1 \leqq \frac{\text{length of sphere}}{\text{breadth of sphere}} \leqq 1.1$$

On the other hand, an average particle diameter of the magnetic spherical particles 5 is preferably set to a value within a range from 30 to 200 μm. When the average particle diameter is smaller than 30 μm, there is a fear such that when scraping, the particles existing at positions away from the brush portion pass through the cleaning blade and reach the position of the primary electrifier, so that an abnormal discharge is caused to cause a damage such as a dielectric breakdown of the photosensitive layer or the like, or the toner is fused and bonded because such a damaged portion becomes a core. On the contrary, when the average particle diameter is so large as to be 200 μm or more, the particles remain in the edge portions of the cleaning blade and the edge portions are damaged, so that a defective cleaning occurs. More preferably, the average diameter is set to a value within a range from 60 to 100 μm. In this case, it is desirable to set a particle diameter of toner to a value within a range from 5 to 15 μm.

On the other hand, as shown in FIG. 1, when the developing device 8*a* for black and the color developing device 8*b* for red or the like are used, there is a case where magnetic bearing members and non-magnetic toner are used as a color developing agent. In this case, by using particles similar to the carriers as the particles to form the brush of the magnet roller 4, the leakage of the carriers due to the carrier fog or background or the like at the time of the development can be also captured and collected by the magnet roller 4.

On the other hand, in order to improve the cleaning performance and to prevent the defective cleaning such as a comb-shaped thinned-out pattern of the toner (toner stripe) or the like, it is desirable to weaken the bonding force between the image bearing member 1 and the toner before scraping and removing the residual toner from the surface of the image bearing member 1 by using the elastic blade 3 arranged downstream of the magnet roller 4 in the moving direction of the bearing member 1. That is, in the case of using the spherical magnetic particles as the particles to scrape the surface of the image bearing member 1 rather than the case of using the monolithic or flat-shaped magnetic particles, the surface area is smaller and the frictional force with the residual toner is smaller, so that an amount of frictional charges which are given to the residual toner can be reduced to a small value and a more stable cleaning performance can be derived.

With this construction, foreign matters such as ozone product and the like which are deposited on the surface of the image bearing member can be effectively removed. Particularly, the occurrence of the trace flow of the electrifier under a high-temperature and high-moisture environment is prevented. The degree of abrasion of the photo sensitive layer on the surface of the image bearing member is extremely small (about 0 to 10 Å when ten thousand papers has been processed). The stable cleaning function can be maintained for a long time.

Examples of experiments of the present invention will now be described.

EXAMPLE 1:

The experiment was executed by using a copying machine comprising: a cylindrical rotational photosensitive material having an amorphous silicon photosensitive layer; a developing device which encloses a developing agent of the two-component system containing a non-magnetic color toner; a developing device which encloses a developing agent of the one-component system consisting of a black magnetic toner; and one cleaning apparatus having a cleaning blade and a magnet roller, wherein those two kinds of developing devices are arranged around the cylindrical photosensitive material such that either one of the developing devices can be selectively used.

A spherical magnetic material (tradename F813: made by Nippon Tetsupun Co., Ltd.) having an average particle diameter of 80 μm to which fluorine acryl had been coated was previously formed on the surface of the magnet roller so as to be form ears by an amount of 100 grams so as to have nip widths within a range from 5 to 8 mm. Under the conditions of a temperature of 30° C. and humidity of 80 % RH, five thousand papers were allowed to be processed per day and, thereafter, the copying machine was stopped for one evening. This cycle was repetitively executed for one week.

The rotating direction of the magnet roller was set to the direction opposite to the direction (the direction indicated by an arrow B in FIG. 2) of the photosensitive material at the position where the photosensitive material is scraped. The photo sensitive material was not heated.

As a result of the above experiment, an amount of photosensitive layer which was ground was about 5 Å until the final stage. The trace flow of the electrifier did not occur in spite of the foregoing circumstances. An amount of charges which are applied to the toner at the position near the magnet roller 4 in the cleaning apparatus 2 was so small as to be about −7 μC/g. It was confirmed that the cleaning state of the toner on the photosensitive material by the cleaning blade 3 was preferably maintained. It is desirable that the spherical magnetic particles are coated by a resin of the fluorine system having a relatively small coefficient of friction because an amount of charges which are given to the residual toner on the photosensitive material is reduced.

EXAMPLE 2:

The experiment similar to the EXAMPLE 1 excluding that the rotating direction of the magnet roller was set to the same direction (the direction indicated by an arrow C in FIG. 2) as that of the photosensitive material at the position where the photosensitive material is scraped was executed. THus a similar good result was derived. Further, the rotating direction of the magnet roller was set to the direction of the arrow C in FIG. 2, it is prevented that the toner in the cleaning apparatus drops under the magnet roller and is scattered to the portions out of the cleaning apparatus.

For this experiment, the comparing experiments were performed under the following conditions.

COMPARISON 1:

The experiment similar to the EXAMPLE 1 except that a flat-shaped magnetic material (tradename DSP: made by Dowa Tetsupun Co., Ltd.) of 30×100 μm was used as a magnetic material to form a brush of the magnet roller was executed.

COMPARISON 2:

The experiment similar to the EXAMPLE 1 excluding that no magnetic particle is formed on the magnet roller and the toner was collected by using only the magnet roller was performed. The shape of the toner was monolithic.

Although no image flow occurred in the COMPARISON 1, when six thousand papers passed, the photosensitive layer was abraded by a thickness of 400 Å. On the other hand, in the COMPARISON 2, the image starts flowing at the time point when about five hundred papers continuously passed. After the copying machine had been stopped for one evening, a typical image flow occurred and the resultant image could not be practically used.

Further, in the COMPARISON 1, an amount of charges applied to the toner near the magnet roller 4 in the cleaning apparatus 2 was so large to be about −12 μC/g, the bonding force to the photosensitive material was enlarged, and the defective cleaning of the toner by the blade occurred.

Figure 3:
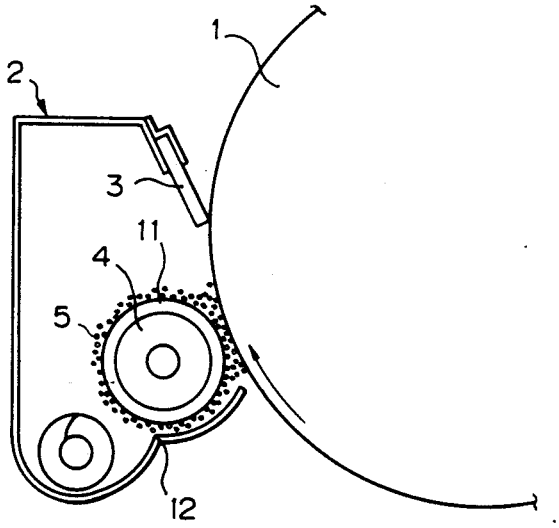
FIG. 3 shows a cross sectional view of the main section of a cleaning apparatus in another embodiment of the invention.

In this embodiment, the magnet roller 4 has been used to hold the magnetic spherical particles. However, the invention is not limited to this roller but can obviously use a cylindrical non-magnetic sleeve 11 having therein the magnet roller 4 as shown in FIG. 3. In this case, the magnet roller 4 is fixed and the sleeve 11 can be rotated. Or, the sleeve 11 is fixed and the magnet roller 4 can be rotated.

On the other hand, although the amorphous silicon photosensitive material has been used as the image bearing member in the embodiment, other photo sensitive material or the like similar to that material can be also used if it is hard and has high abrasion resistance.

Further, in this embodiment, although the blade has been brought into contact with the image bearing member on the downstream side than the magnet roller in the moving direction of the image bearing member, a brush can be also used in place of the blade.

As described above, according to the invention, the abrasion of the image bearing member such as a photosensitive material or the like is minimized and a defective image such as trace flow of the electrifier, dimmed image, or the like can be eliminated irrespective of the circumstances. Further, any of the magnetic toner and non-magnetic toner can be sufficiently collected. The excellent cleaning function can be stably maintained for a long time. Thus, the invention is advantageous for obtaining an image of good quality.

What is claimed is:

1. An image forming apparatus, comprising:
a movable photosensitive member;
means for developing, with a developing agent, a latent image obtained by charging and exposing said photosensitive member;
transfer means for transferring the developed image onto a recording sheet;
first cleaning means for cleaning said photosensitive member by being brought into contact therewith; and
second cleaning means arranged upstream of said first cleaning means with respect to the moving direction of said photosensitive member;
said second cleaning means being spaced from said photosensitive member and having magnetic particle holding means for holding spherical magnetic particles, wherein said spherical magnetic particles held by said holding means are caused to scrape the surface of said photosensitive member to clean it.

2. An apparatus according to claim 1, wherein said means for holding the magnetic particles is a magnet roller.

3. An apparatus according to claim 1, wherein said means for holding the magnetic particles is a non-magnetic sleeve having therein a magnet roller.

4. An apparatus according to claim 1, wherein the surface of said photosensitive member has an amorphous silicon photosensitive layer.

5. An apparatus according to claim 1, wherein said image forming apparatus further includes:
latent image forming means, arranged downstream of said first cleaning means with respect to the moving direction of said photosensitive member, for forming a latent image on said photosensitive member 6. An apparatus according to claim 1, wherein said developing agent has an insulative non-magnetic toner and magnetic carrier particles.

7. An apparatus according to claim 1, wherein an average particle diameter of said spherical magnetic particles is set to a value within a range from 30 to 200 μm.

8. An apparatus according to claim 7, wherein the average diameter of the spherical magnetic particles is set to a value within a range from 60 to 100 μm.

9. An apparatus according to claim 1, wherein said spherical magnetic spherical particles are made of ferrite.

10. An apparatus according to claim 1, wherein a saturation magnetizing force of said spherical magnetic particles is set to a value within a range from 60 to 80 emu/g.

11. An apparatus according to claim 6, wherein said magnetic carrier particles are the same as said magnetic spherical particles.

12. An apparatus according to claim 5, wherein said latent image forming means has charging means for charging said photosensitive member and said charging means is a corona charging means.

13. An apparatus according to claim 5, wherein said transfer means is a corona transferring means.

14. An apparatus according to claim 1, wherein said spherical magnetic particles are coated with a resin of the fluorine system.

15. A cleaning apparatus, comprising:
first cleaning means for cleaning a photosensitive member by being brought into contact therewith; and
second cleaning means arranged upstream of said first cleaning means with respect to the moving direction of said photosensitive member,
said second cleaning means being spaced from said photosensitive member and having magnetic particle holding means for holding spherical magnetic particles, wherein said spherical magnetic particles held by said magnetic particles holding means are caused to scrape the surface of said photosensitive member to clean it.

16. A cleaning method, comrpising:
a first step of scraping a photosensitive member with spherical magnetic particles held by magnetic particle holding means spaced from the photosensitive member for cleaning the photosensitive member; and
a second step of cleaning the photosensitive member by cleaning means arranged downstream of said magnetic particle holding means with respect to the moving direction of the photosensitive member and in contact with the photosensitive member.

17. An image forming apparatus, comrpising:
a photosensitive member;
means for developing, with a developing agent, a latent image obtained by charging and exposing said photosensitive member;
transfer means for transferring the developed image onto a recording sheet; and
holding means disposed apart from said photosensitive member for holding spherical magnetic particles, wherein the spherical magnetic particles held by said holding means are caused to scrape said photosensitive member to clean it.

* * * * *

UNITED STATES PATENT AND TRADEMARK OFFICE

CERTIFICATE OF CORRECTION

PATENT NO. : 4,972,233 Page 1 of 2

DATED : November 20, 1990

INVENTOR(S) : Yamazaki, et al.

It is certified that error appears in the above-identified patent and that said Letters Patent is hereby corrected as shown below:

AT [57] ABSTRACT:

Line 1, "A" should read --An--.

Line 6, "magnet spherical particles" should read --spherical magnet particles--.

Line 13, "photo sensitive layer" should read --photosensitive layer--.

COLUMN 1:

Line 17, "of" should read --or--; and "into with" should read --into contact with--.

COLUMN 5:

Line 21, "photo sensitive layer" should read --photosensitive layer--.

Line 47, delete "be".

COLUMN 6:

Line 15, "the" (first occurrence) should read --since the--.

Line 61, "photo sensitive" should read --photosensitive--.

UNITED STATES PATENT AND TRADEMARK OFFICE

CERTIFICATE OF CORRECTION

PATENT NO. : 4,972,233 Page 2 of 2

DATED : November 20, 1990

INVENTOR(S) : Yamazaki, et al.

It is certified that error appears in the above-identified patent and that said Letters Patent is hereby corrected as shown below:

COLUMN 7:

Line 47, "ber" should read --ber.--.

COLUMN 8:

Line 31, "said magnetic particles holding means" should read --said matnetic particle holding means--.

Line 34, "comrpising:" should read --comprising:--.

Signed and Sealed this

Fourth Day of August, 1992

*Attest:*

DOUGLAS B. COMER

*Attesting Officer*

*Acting Commissioner of Patents and Trademarks*